US008105100B1

(12) United States Patent
Cheng

(10) Patent No.: US 8,105,100 B1
(45) Date of Patent: Jan. 31, 2012

(54) POWER CONVERTER WITH ROTATABLE PLUG

(75) Inventor: Ching-Hua Cheng, Taipei Hsien (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 0 days.

(21) Appl. No.: 13/083,549

(22) Filed: Apr. 9, 2011

(51) Int. Cl.
*H01R 29/00* (2006.01)

(52) U.S. Cl. ..... 439/188

(58) Field of Classification Search ..... 439/188, 439/668, 669, 944
See application file for complete search history.

(56) References Cited

U.S. PATENT DOCUMENTS

| | | | | |
|---|---|---|---|---|
| 7,150,648 | B1 * | 12/2006 | Hall et al. | 439/581 |
| 7,874,855 | B1 * | 1/2011 | Ye et al. | 439/188 |
| 2006/0128194 | A1 * | 6/2006 | Wang et al. | 439/188 |
| 2009/0305537 | A1 * | 12/2009 | Esposito | 439/188 |

* cited by examiner

*Primary Examiner* — Jean F Duverne
(74) *Attorney, Agent, or Firm* — Chun-Ming Shih; HDLS IPR Services

(57) ABSTRACT

The power converter of the invention includes a housing, two conductive pins, a flexible arm and a plug. The housing has a recess. The conductive pins protrude from the recess. The flexible arm is formed with a protrudent plate and a positioning block, which protrude from the recess. The protrudent plate is located beside the conductive pins. The plug includes a disk and two leads. The protrudent plate presses either of the conductive pins when the flexible arm is depressed so that the conductive pins move away from the leads to form a disconnection. The conductive pins connect to the leads when the disk is positioned by the positioning block.

10 Claims, 9 Drawing Sheets

POWER CONVERTER WITH ROTATABLE PLUG

BACKGROUND OF THE INVENTION

1. Technical Field

The invention relates to power converters, particularly to power converters with rotatable plugs.

2. Related Art

Many electronic devices require a converter to supply power or be charged. There are many kinds of plugs in the world. Thus some converters are configured to be capable of changing different plugs. That is, various kinds of plugs are releasably fastened to a converter body. A user may choose a specific plug to fasten to a converter body depending on practical requirements.

Conventionally, the plug of a converter has two leads and two conductive pins are disposed in the converter body. The leads separately connect to the conductive pins when the plug is fastened to the converter body. Thus, the converter can work.

The plug is fastened to the converter body by a slide or rotation manner. The leads of the plug tend to make a poor contact with the conductive pins because of inaccurate positioning. Thus, there is potential risk in using these conventional converters.

SUMMARY OF THE INVENTION

An object of the invention is to provide a converter with a rotatable plug, which can ensure a good contact between the plug and the conductive pins to avoid poor contact.

An object of the invention is to provide a converter with a rotatable plug, which has guiding structure for exactly fastening the plug into the housing.

To accomplish the above objects, the invention includes a housing, two conductive pins, a flexible arm and a plug. The housing has a recess. The conductive pins protrude from the recess. The flexible arm is formed with a protrudent plate and a positioning block, which protrude from the recess. The protrudent plate is located beside the conductive pins. The plug includes a disk and two leads. The protrudent plate presses either of the conductive pins when the flexible arm is depressed so that either of the conductive pins move away from the leads to form a disconnection. The conductive pins connect to the leads when the disk is positioned by the positioning block.

DETAILED DESCRIPTION OF THE INVENTION

Figure 1:
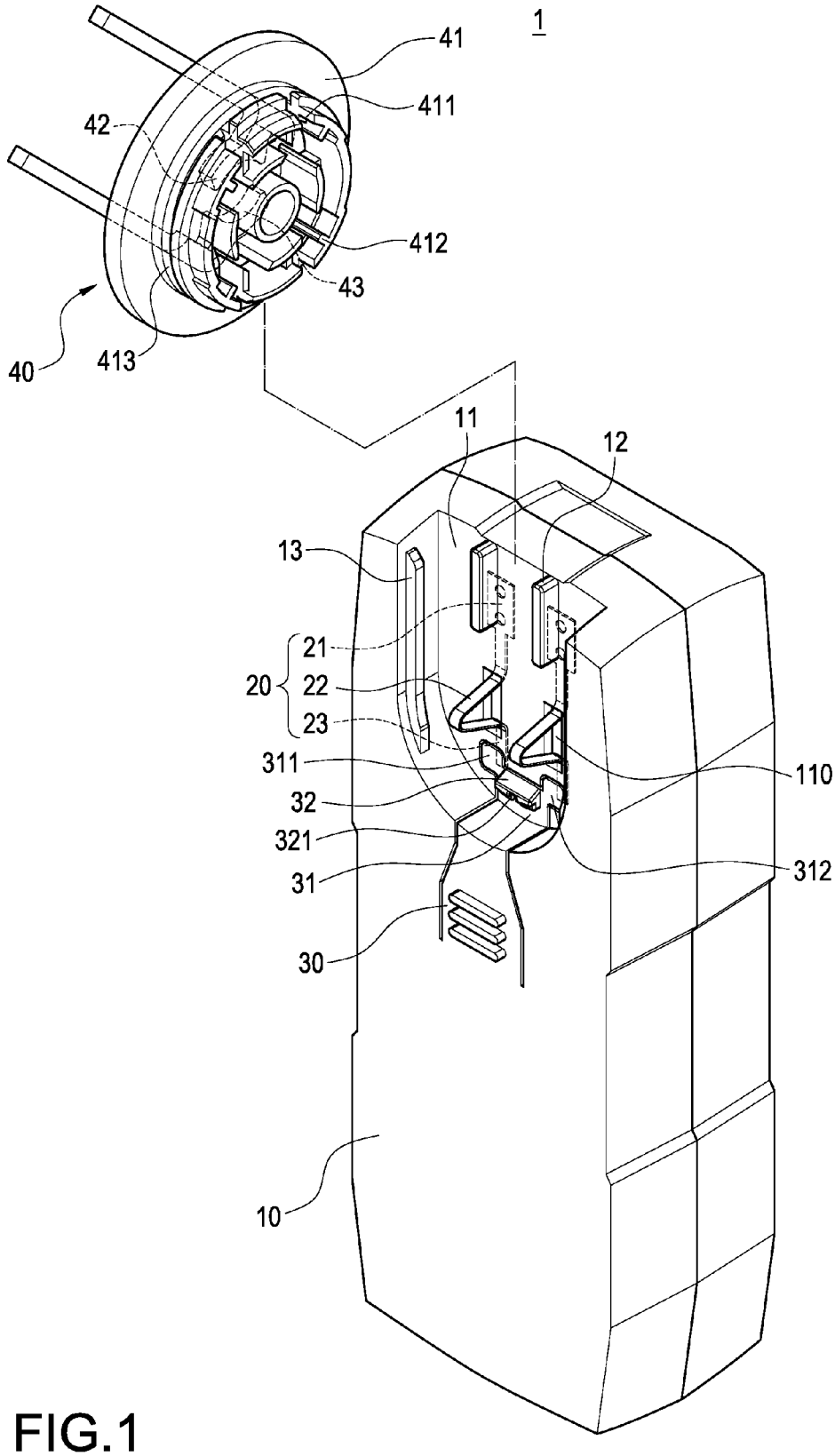
FIG. 1 is an exploded view of the invention.
Figure 2:
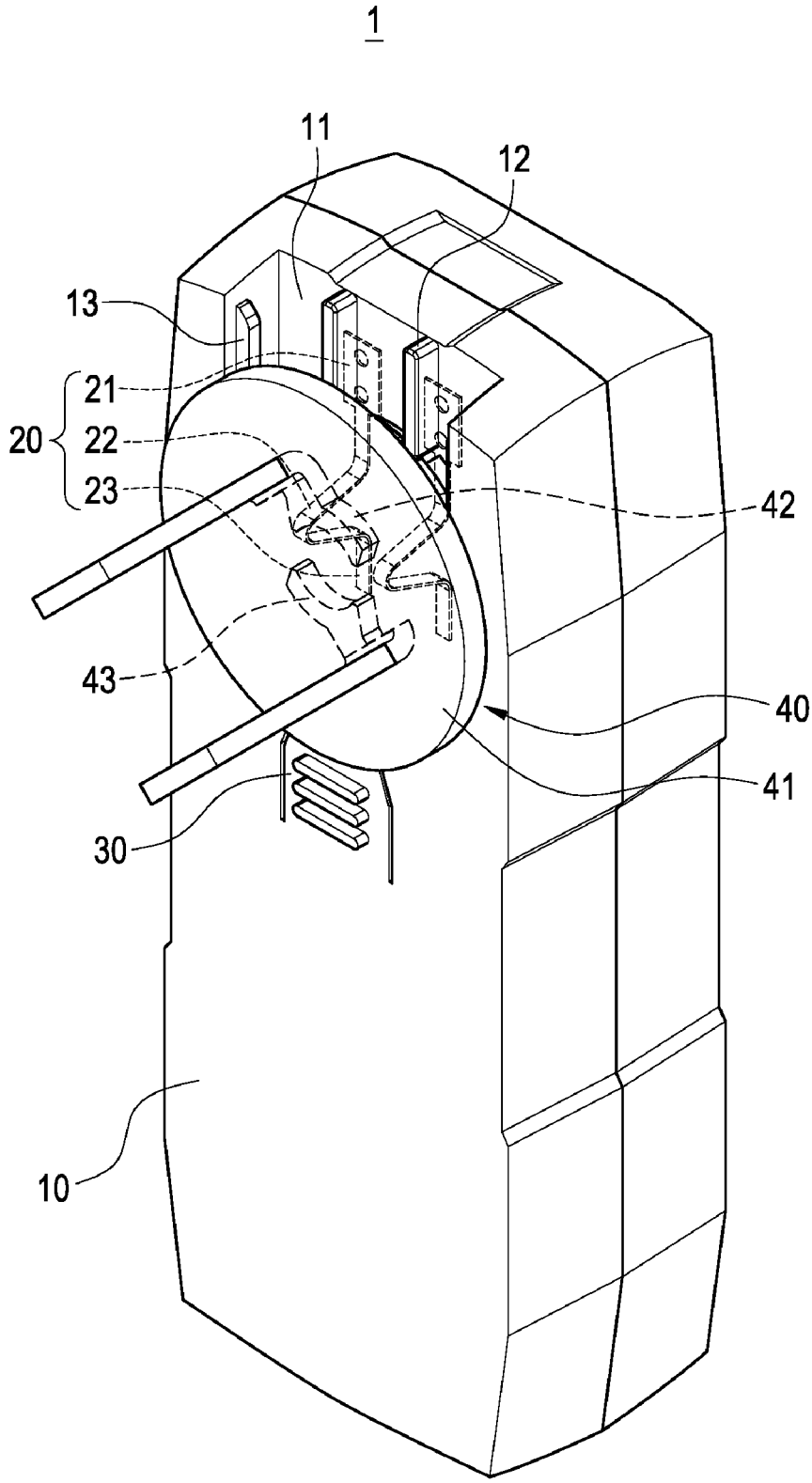
FIG. 2 is an assembled view of the invention.
Figure 3:
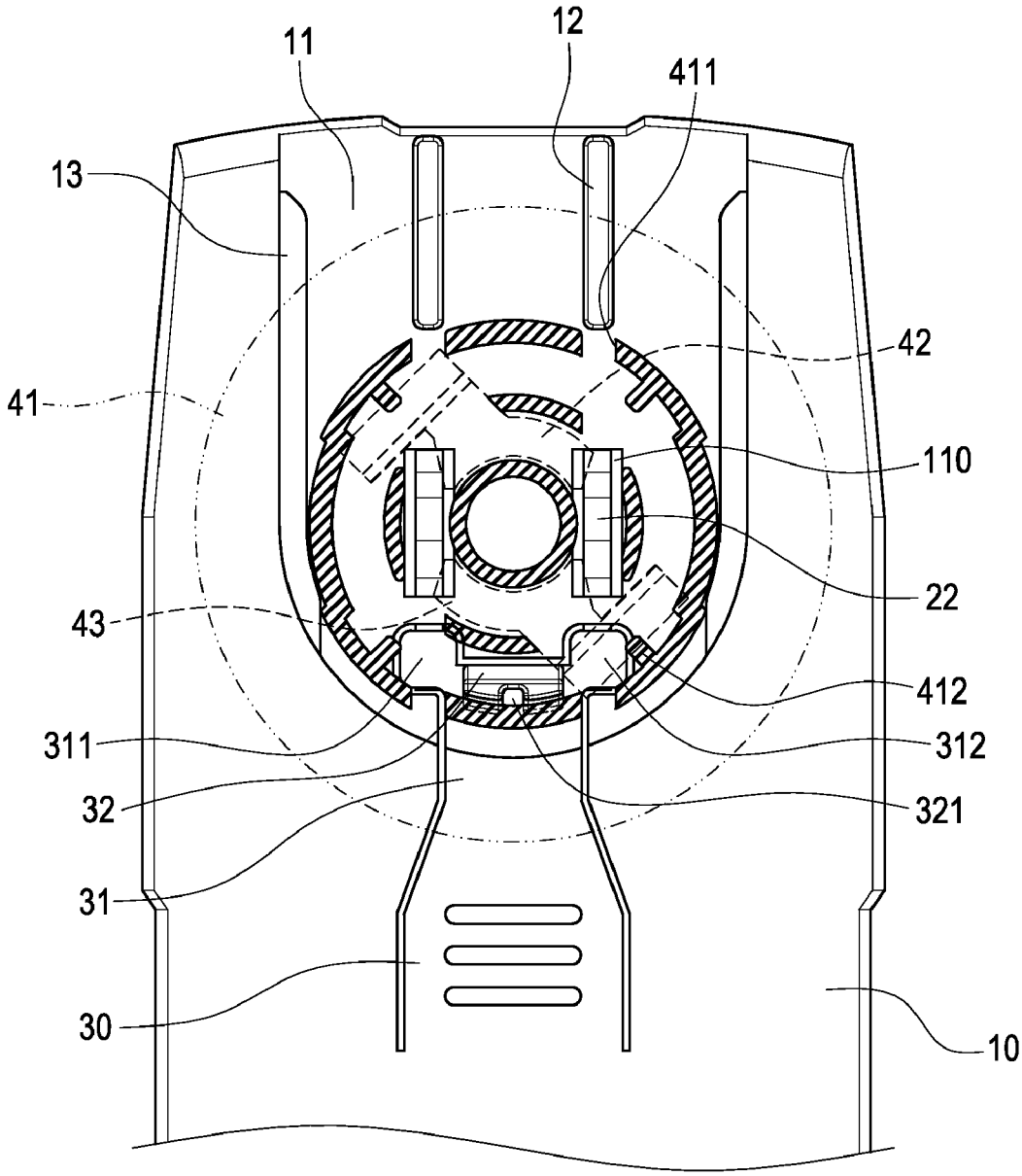
FIG. 3 is a transversal cross-sectional view of the invention.
Figure 4:
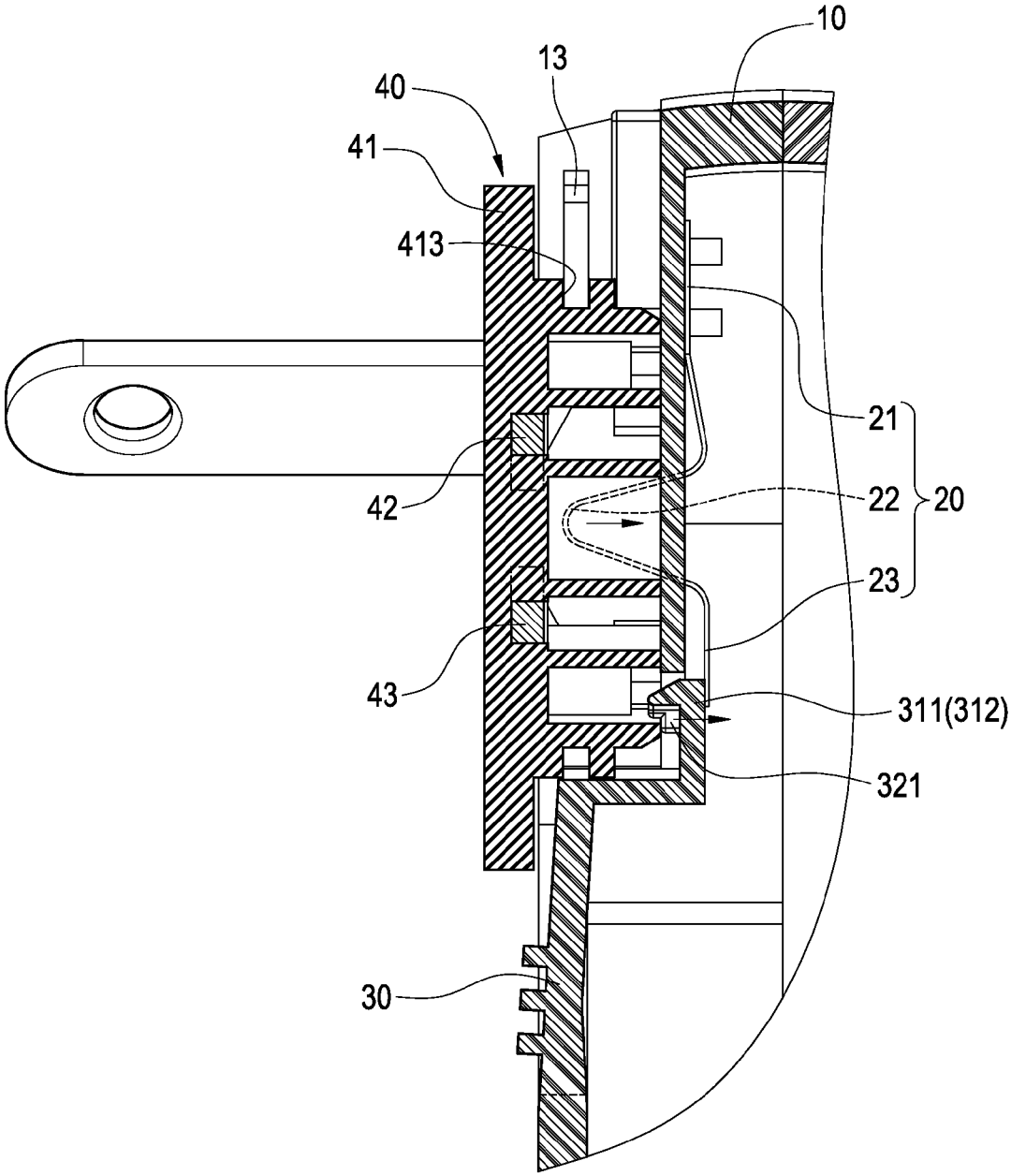
FIG. 4 is a longitudinal cross-sectional view of the invention.
Figure 5:
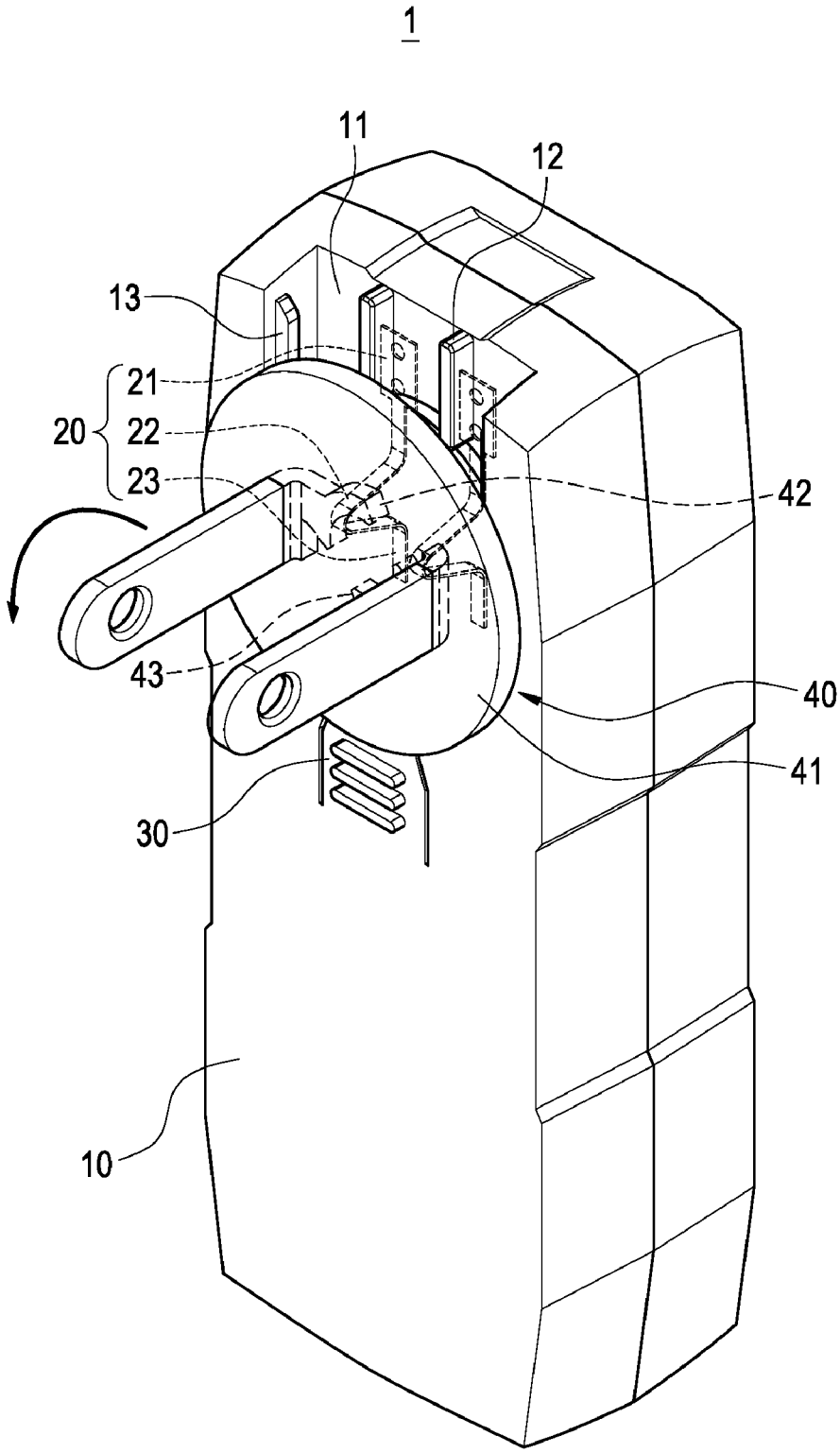
FIG. 5 is a perspective view showing the plug is rotating.
Figure 6:
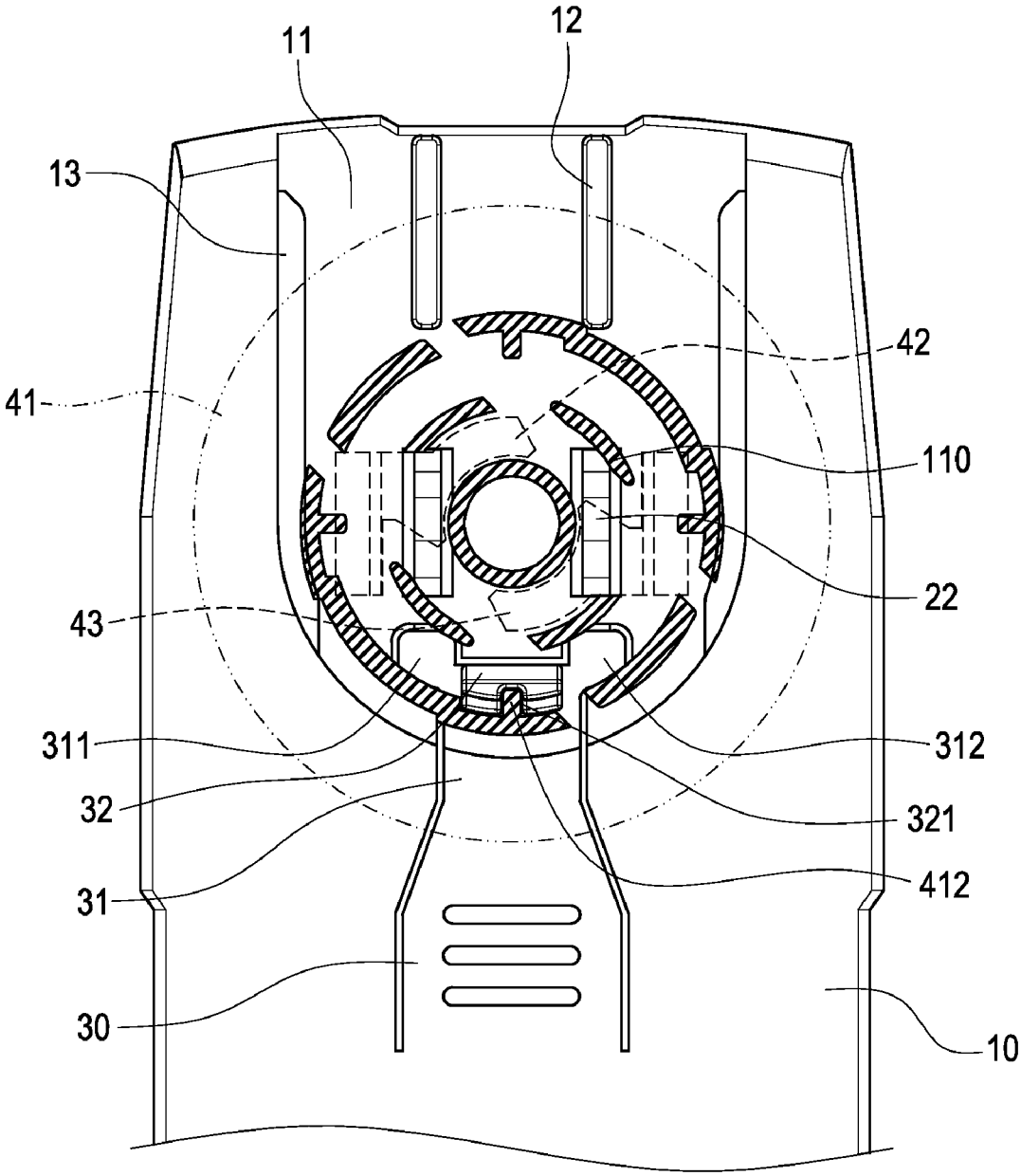
FIG. 6 is FIG. 3 with the plug in another direction.
Figure 7:
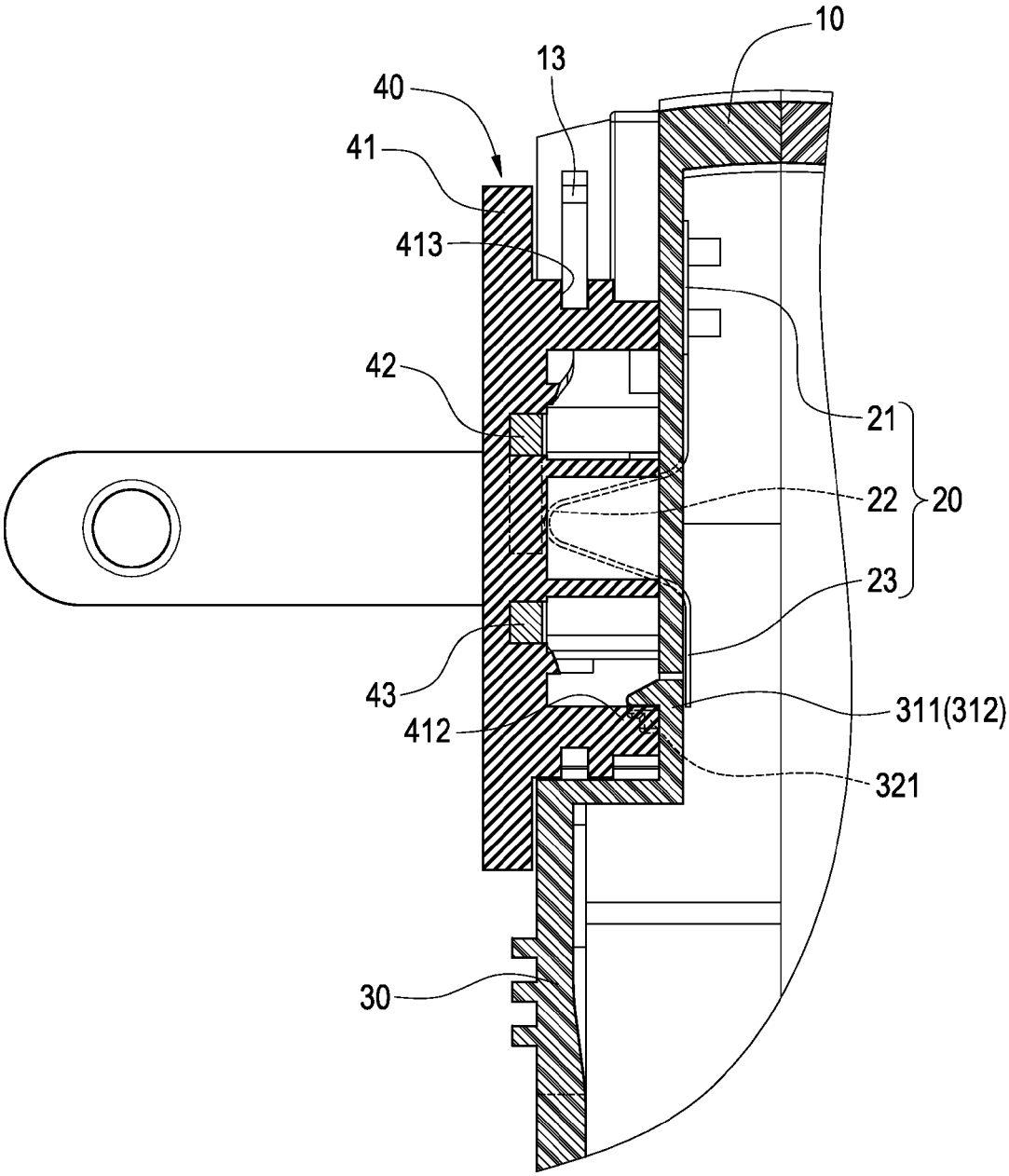
FIG. 7 is FIG. 4 with the plug in another direction.

Please refer to FIGS. 1-3. The power converter 1 of the invention includes a housing 10, two conductive pins 20, a flexible arm 30 and a plug 40.

The housing 10 is approximately of, but not limited to, a cuboid. The housing has a recess 11. One end of the recess 11 is formed with two guiding ribs 12. Two opposite sides of the recess 11 are separately formed with two sliding ribs 13. Two openings 110 are provided in the recess 11.

The two conductive pins 20 are fixed on the housing 10 and protrude from the recess 11. In this embodiment, one end of each the conductive pin 20 is a free end. Each the conductive pin 20 includes a fixture section 21, a contact section 22 extending from the fixture section 21 and a press section 23 extending from the contact section 22. The contact section 22 protrudes from the recess 11 and both the fixture section 21 and press section 23 are located in the housing 10. In this embodiment, the press section 23 is a free end. The contact section 22 is of a V shape and protrudes from the opening 110.

The flexible arm 30 is formed on the housing 10 and at one side of the recess 11. The flexible arm 30 is provided with a protrudent plate 31 and a positioning block 32, which protrude from the recess 11. The protrudent plate 31 is beside the conductive pins 20. In this embodiment, the protrudent plate 31 is defined with two depressing areas 311, 312 separately depressing the two press sections 23 of the conductive pins 20. The positioning block 32 is disposed on the protrudent plate 31 and between the two depressing areas 311, 312. There is a positioning trough 321 in the positioning block 32.

The plug 40 includes a disk 41 and two leads 42, 43 for connecting the conductive pins 20. The disk 41 is provided with guiding troughs 411, positioning ribs 412 being selectively embedded in the positioning trough 321 and a flange 413. In this embodiment, the disk 41 is formed with four positioning ribs 412 on the side facing the recess 11. These four ribs 412 are arranged into two pairs and two of each pair are corresponding.

Please refer to FIGS. 4-7. When using the power converter 1, the guiding troughs 411 of the disk 41 are aligned with and embedded by the guiding ribs 12, so that the plug 40 is positioned in the housing 10 by sliding. And the flange 413 abuts against the positioning block 32 as shown in FIG. 3.

When a user depresses the flexible arm 30 to have the protrudent plate 31 depress either of the conductive pins 20, either of the conductive pins 20 (the contact sections 22) is moved away from the conductive pins 42, 43. Thus the conductive pins 20 electrically disconnect with the leads 42, 43. Besides, the flexible arm 30 moves towards the inside of the housing 10 while it is being depressed. Thus, depressing the flexible arm 30 may make the flange 413 escape being blocked by the positioning block 32. At this time, rotating the disk 41 may embed the positioning rib 412 into the positioning trough 321. The contact sections 22 of the conductive pins 20 will not restore to its originally exposed status until the disk 41 has been positioned in the positioning block 32 and the force which is exerted on the flexible arm 30. After that, the leads 42, 43 make electrical connections with the contact sections 22.

Figure 8:
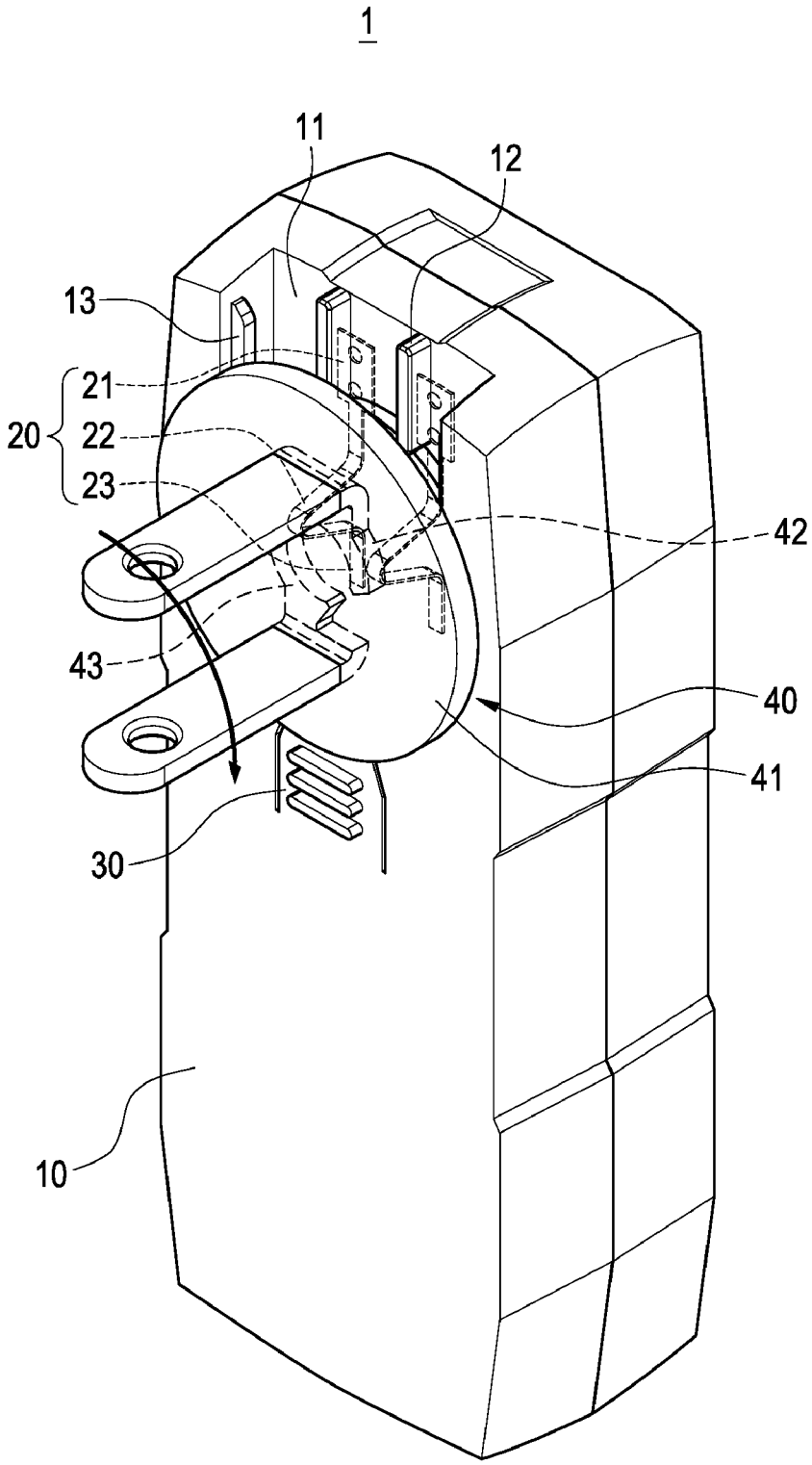
FIG. 8 is FIG. 2 with the plug in another direction.
Figure 9:
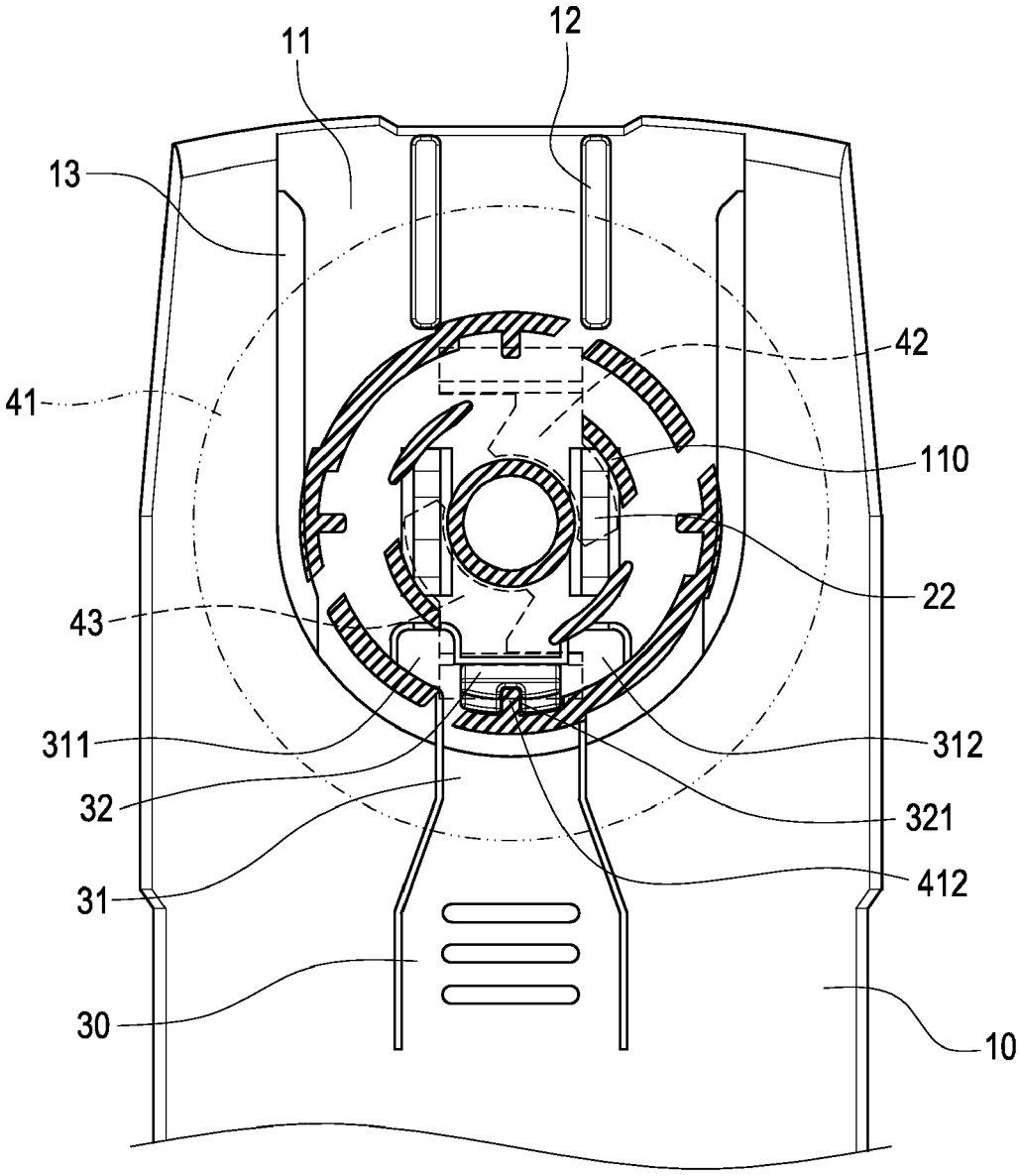
FIG. 9 is FIG. 6 with the plug in still another direction.

Please refer to FIGS. 8 and 9. The plug 40 of the power converter 1 can be rotated. When rotating the plug 40 is needed, the flexible arm 30 must be first depressed to make the positioning rib 412 escape from the positioning trough 321 and to make disk 41 escape from being blocked by the positioning block 32. At this time, the depressing areas 311, 312 of the protrudent plate 31 will depress the conductive pins 20 to form a disconnection between the conductive pins 20 and the leads 42, 43. Thus, a poor contact may be avoided.

Then, the disk 41 is rotated in the recess 11. At this time, the flange 413 of the disk 41 may be moved between the two sliding ribs 13. Once the disk 41 has been rotated to a desired direction, the force which is originally exerted on the flexible arm 30 is removed to make the contact sections 22 of the conductive pins 20 restore to its originally exposed status and the leads 42, 43 make electrical connections with the contact sections 22 again. Meanwhile, the positioning rib 412 is embedded in the positioning trough 321.

While the forgoing is directed to a preferred embodiment of the present invention, other and further embodiments of the invention may be devised without departing from the basic scope thereof. As such, the appropriate scope of the invention is to be determined according to the claims.

What is claimed is:

1. A power converter comprising:

a housing having a recess;

two conductive pins, assembled in the housing and partially protruding from the recess;

a flexible arm, formed on the housing, having a positioning block and a protrudent plate beside the two conductive pins; and a plug including a disk and two leads for separately connecting the two conductive pins;

wherein either of the conductive pins is depressed by the protrudent plate when the flexible arm is depressed, then exposed portions of the conductive pins are moved away from the leads to form a disconnection, and the conductive pins separately connect to the leads when the disk is positioned by the positioning block.

2. The power converter of claim 1, wherein the disk is provided with a guiding trough, one end of the recess is formed with a guiding rib, and the guiding trough allows the guiding rib to pass through for fastening the plug on the housing.

3. The power converter of claim 1, wherein two opposite sides of the recess are separately formed with two sliding ribs, the disk is formed with a flange, and the flange moves between the sliding ribs when the disk is rotating in the recess.

4. The power converter of claim 1, wherein the disk is partially blocked by the positioning block, depressing the flexible arm makes the disk escape from being blocked, and then the disk is further rotated to be blocked by the positioning block.

5. The power converter of claim 1, wherein each the conductive pin includes a fixture section, a contact section extending from the fixture section and a press section extending from the contact section, the contact section protrudes from the recess, and both the fixture section and press section are located in the housing.

6. The power converter of claim 5, wherein one end of each the conductive pin is a free end, and the press section is the free end.

7. The power converter of claim 5, wherein two openings are provided in the recess, and the contact section is of a V shape and protrudes from one of the openings.

8. The power converter of claim 1, wherein the protrudent plate is defined with two depressing areas separately depressing the two press sections of the conductive pins, the positioning block is disposed on the protrudent plate and between the two depressing areas.

9. The power converter of claim 1, wherein the disk is provided with a positioning rib, the positioning block is provided with a positioning trough being embedded by the positioning rib.

10. The power converter of claim 9, wherein the disk is formed with four positioning ribs on a side facing the recess, the four ribs are arranged into two pairs, and two of each pair are corresponding.

* * * * *